US007553261B2

(12) United States Patent
Carbone

(10) Patent No.: US 7,553,261 B2
(45) Date of Patent: Jun. 30, 2009

(54) MULTIFUNCTION EXERCISE EQUIPMENT

(76) Inventor: Giuseppe Carbone, Via Lambertesca, 16, 50122 Firenze (IT)

( * ) Notice: Subject to any disclaimer, the term of this patent is extended or adjusted under 35 U.S.C. 154(b) by 421 days.

(21) Appl. No.: 11/021,255

(22) Filed: Dec. 22, 2004

(65) Prior Publication Data

US 2005/0164848 A1 Jul. 28, 2005

(30) Foreign Application Priority Data

Jan. 22, 2004 (EP) ..... 04425032

(51) Int. Cl.
*A63B 21/00* (2006.01)

(52) U.S. Cl. ..... 482/72; 482/51

(58) Field of Classification Search ..... 482/72, 482/121, 126, 51, 142, 90, 111, 112
See application file for complete search history.

(56) References Cited

U.S. PATENT DOCUMENTS 228,845 A * 6/1880 Blickman ..... 482/72
1,727,657 A * 9/1929 Martin ..... 482/72
1,911,572 A * 5/1933 Hulander et al. ..... 482/142
1,928,089 A * 9/1933 Blickman ..... 482/90
1,979,716 A * 11/1934 Terry ..... 482/72
4,684,126 A * 8/1987 Dalebout et al. ..... 482/138
5,582,567 A * 12/1996 Chang ..... 482/146
6,022,304 A * 2/2000 Tornabene et al. ..... 482/140
6,244,995 B1 6/2001 Prsala ..... 482/96
2002/0022558 A1 2/2002 Casey ..... 482/95
2002/0115537 A1* 8/2002 Lin ..... 482/72

FOREIGN PATENT DOCUMENTS

EP 0259134 3/1988
GB 406123 2/1934

* cited by examiner

*Primary Examiner*—Jerome Donnelly
(74) *Attorney, Agent, or Firm*—Pollack, P.C.

(57) ABSTRACT

An exercise apparatus is disclosed, which comprises a pedestal, a seat supported by the pedestal, and at least two handle members mounted to opposing sides of the pedestal, to be gripped generally at their top end by a user oriented relative to the seat. The pedestal has a curved base for permitting rocking movement of the pedestal about a substantially intermediate axis, generally orthogonal to opposing sides on which the handle members are placed. The handle members preferably include bar-shaped structures hinged to the pedestal via respective ball joints.

13 Claims, 5 Drawing Sheets

MULTIFUNCTION EXERCISE EQUIPMENT

FIELD OF THE INVENTION

The present invention relates generally to exercise and, more specifically, to equipment for athletic and other exercise of all parts of the body.

BACKGROUND OF THE INVENTION

Conventional multifunction exercise equipment typically comprise a pedestal with a seat, e.g., of a slidable type, and a plurality of posts standing on the pedestal and supporting, at free ends thereof, respective disk-shaped rotors with handles to be gripped by a user while in a seated position, or otherwise positioned, on the seat. The handles are affixed to the appropriate rotor, off-center relative to the axis of rotation and integral with the post. In this manner, using a rhythmic reciprocating movement of his/her arms, the user causes the rotors to spin, such movement being somewhat similar to that performed in turning a winch, and possibly assisted by, and combined with, cyclical flexion of the user's spine.

OBJECTS AND SUMMARY OF THE INVENTION

Accordingly, it is an object of the present invention to provide a multifunction exercise apparatus or equipment that is not only more dynamic and versatile than conventional exercise arrangements, but also extraordinarily more effective.

Another object of the present invention is to provide a multifunction exercise apparatus that is adaptable to fit the physical characteristics of any user, as well as to accommodate his or her needs and muscular/articular capabilities.

SUMMARY OF THE INVENTION

According to one aspect of the present invention, exercise equipment or an apparatus is provided, which comprises a pedestal, a seat supported by the pedestal, and a plurality of handle members mounted to opposing sides of the pedestal, to be gripped generally at a top end by a user oriented relative to the seat, the pedestal having a curved base for permitting rocking movement of the pedestal about an intermediate axis, normal relative to the sides on which the handle members are arranged, the handle members including bar-shaped structures hinged to the pedestal via respective ball joints.

According to another aspect of the present invention, the pedestal of the apparatus described above further defines a top plane on which the seat is slidably mounted, whereby the user may assist the manual action on the handle members with a flexion movement of his or her spine. The handle members, in addition to being telescopically extendable for adjusting the height of the grip, can, in turn, be mounted for displacement over the pedestal, optionally also along an arc-shaped structure projecting generally laterally from the pedestal, and coplanar relative to the top plane of the same. Alternatively or concurrently, the handle members are provided with additional, respective, ball joints in proximity to the top ends so as to provide a further hinge of the grip relative to the body of the handle member.

BRIEF DESCRIPTION OF THE DRAWINGS

Specific, illustrative multifunction exercise equipment, in accordance with the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
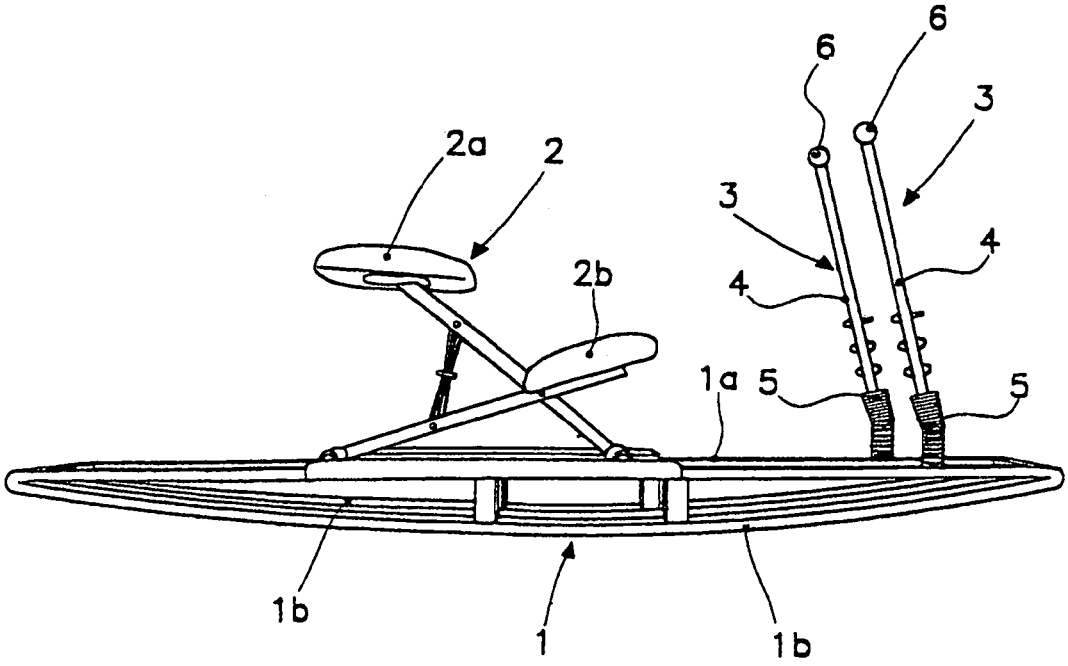
FIG. 1 is a side view of exercise equipment, according to one aspect of the present invention.
Figure 2:
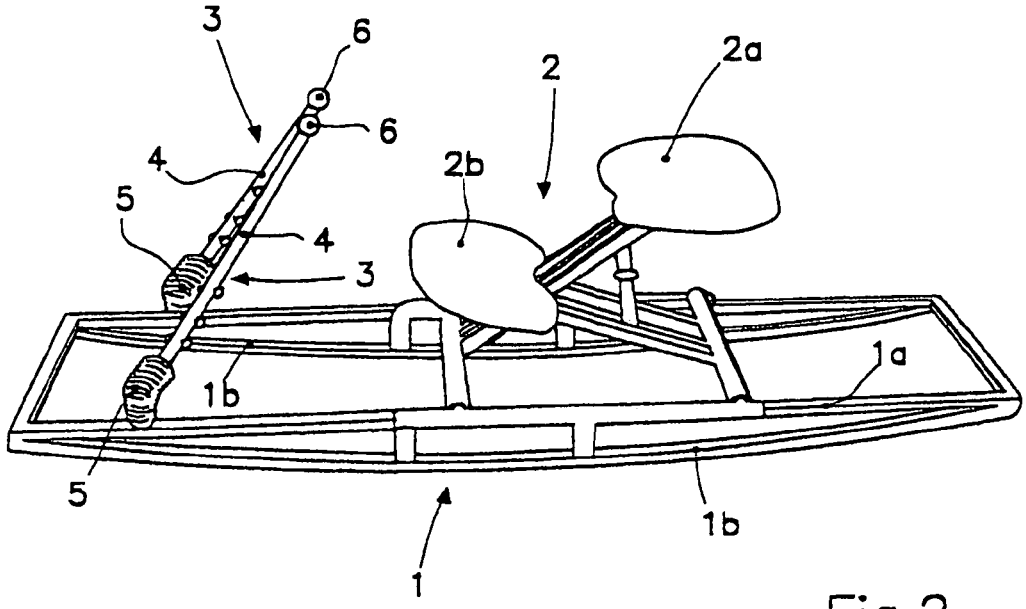
FIG. 2 is an opposing side view of the equipment, from a more elevated perspective relative to the view shown in FIG. 1.

Referring now to the drawings and, more particularly, to FIGS. 1-4*f*, there is shown generally a specific, illustrative multifunction exercise apparatus or equipment, in accordance with various aspects of the present invention. According to one embodiment, illustrated generally in FIGS. 1 and 2, the apparatus comprises a pedestal 1, having a network structure constructed preferably of a selected metallic compound, with an tipper or top frame 1*a* and two base arc-shaped beams 1*b*, projecting along respective longer sides of the top frame, and in a direction generally orthogonal to the plane in which the same frame lies. The arcuate shape formed by the base beams enables pedestal 1 to rock about an axis X, relatively parallel to a plane of the ground or other surface upon which the base rests, the axis being oriented crosswise (that is, generally orthogonally to the longer sides of frame 1*a*), and in a substantially intermediate position.

Pedestal 1 supports a seat 2 that includes, for instance, an adjustable ergonomic stool of a conventional type, having a sitting board 2*a* and a front support 2*b* for the knees of the user, connected in a relatively stable manner to the longer sides of frame 1*a* and in an intermediate position, i.e., substantially in correspondence to the rocking or X axis.

Frame 1*a* also mounts a plurality of handle members 3, in a frontally displaced position, to be grasped by a user when positioned in seat 2 and extending his or her arms forward. The handle members are preferably mounted on respective longer sides of the frame, at points generally transverse in-line, and close to, a front shorter side thereof. Each handle member 3 comprises a bar 4, detachably mounted to the frame in a relatively stable manner (detachable, for instance, using a screw system) at a lower end of the frame via a ball joint 5 that permits relatively free articulation of the bar in any direction. In addition, a telescopic structure with locking system (not shown) is provided for adjusting the length of the bar. Rings 4*a* may be provided, in addition, for attaching auxiliary elastic straps, such straps increasing the degree of resistance and, thereby, hindering the articulation of member 3 about joint 5.

It is preferred that the upper or top end of each bar be designed specifically so as to facilitate grasping by a user. For this purpose, the top ends, according to the present embodiment, are each provided with a knob 6 for assisting the user in his or her use of the manual clutch while making such use more comfortable for the user. According to one embodiment, the knobs are integral with the body of member 3, in general, and the bar, in particular. Alternatively or concurrently, knobs 6, or an analogous gripping arrangement, may, in turn, be articulated relative to the bar by additional ball joints, respectively. In this manner, the degrees of freedom of movement of the point of gripping are further increased.

The user, by grasping handle members 3 and moving them according to predetermined and coordinated sequences, may then carry out with his or her arms generally circular or elliptical movements, linearly reciprocating, zigzag, and/or winding movements and many others, all with optimum variety, freedom and dynamism. In this manner, virtually all muscles and articulations of the body are involved in the exercise process, especially considering that the rocking pedestal necessitates the assistance of a balancing action of the lower part of the user's body: in particular, muscles and articulations of the abdomen, of the pelvis and of the lower limbs.

Figure 3:
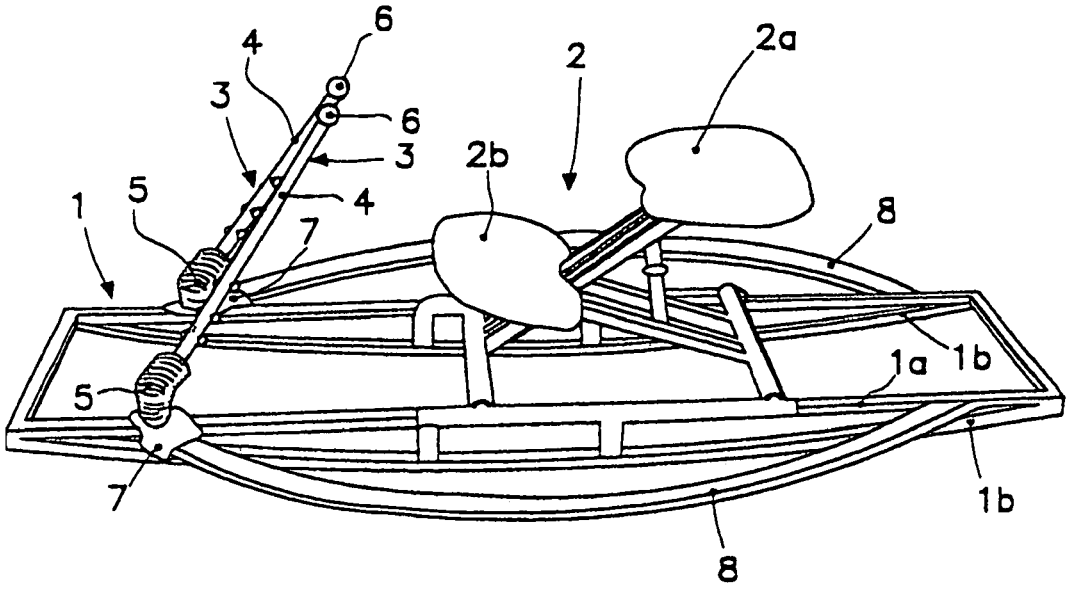
FIG. 3 is an opposing side view of the equipment, according to another aspect of the present invention.

Referring now to FIG. 3, according to another embodiment of the present invention, ball joints 5 at the base of handle members 3 are mounted to brackets 7, rather than directly to frame 1*a*. The brackets, for instance, are slidable and lockable in a desired position substantially along the whole periphery of the frame. Optionally, an auxiliary, generally arc-shaped structure may also be provided, such structure lying coplanar to the frame, suitably for allowing displacement of the handle members, even at an increased distance sideways from the user. In the example of FIG. 3, the structure comprises a couple of arc-shaped rods 8, projecting outwardly from the longer sides of frame 1*a*. Advantageously, this arrangement, in addition to further increasing the range of movements and exercises that may be accomplished (considering also the possibility of an asymmetrical placement of the two handle members), is further beneficial in providing a high degree of adaptability such that the equipment can readily accommodate different anthropometric characteristics of the user.

Figure 4A:
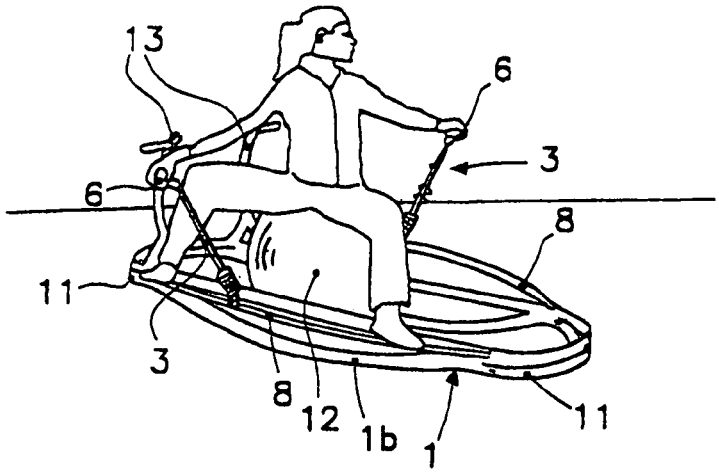
FIGS. 4*a*-4*f* illustrate equipment, according to further aspects of the present invention, exemplifying selected uses in connection with various auxiliary implements.
Figure 4B:
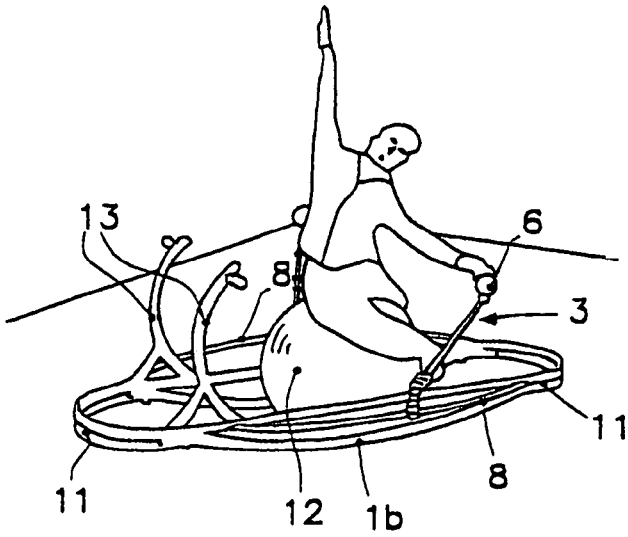
Figure 4C:
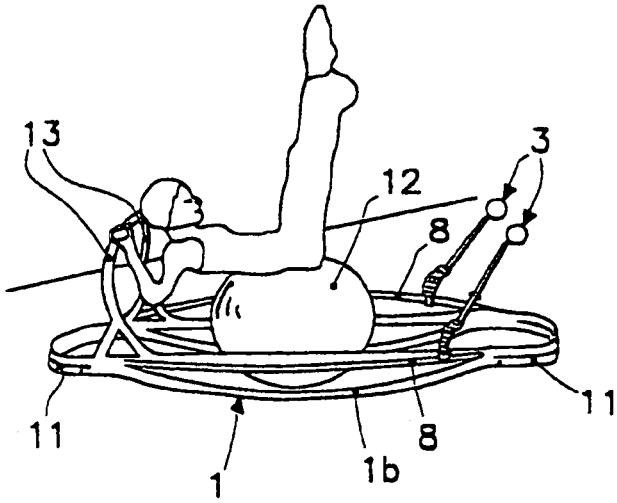

As shown in FIGS. 4*a*-4*f*, the present invention is suitable for a number of other embodiments, in particular, with a pedestal 1 that can be used to support various auxiliary implements. In FIGS. 4*a*-4*c*, in an apparatus substantially analogous to the embodiment of FIG. 3, seat 2 has been removed and replaced by an inflatable sphere 12, simply laid over a relatively circular ring, not visible in the drawing, that is coplanar with frame 1*a*, and integral or slidable with respect to the same frame. Desirably, sphere 12 provides a sitting that is less stable than seat 2 and, as such, is particularly advantageous for balance training and increasing the proprioceptive sensibility of the user.

Again with reference to FIGS. 4*a*-4*c*, in addition to ball-jointed knobs 6 at the top end of bar 4, two fixed uprights 13 stand integrally on pedestal 1 for gripping at the top ends by the user. The fixed uprights may be used as an auxiliary support, brace or abutment. Furthermore, the two longitudinal ends of pedestal 1 comprise two hinged structures pivotable downwardly and in an adjustable manner, so as to abut on the ground plane and either limit the extent of rocking, or prevent the same entirely.

Figure 4D:
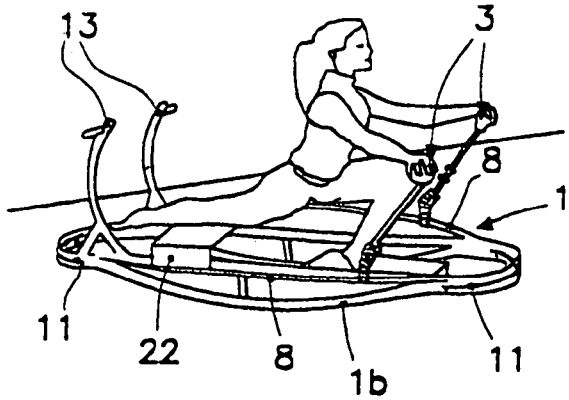
Figure 4E:
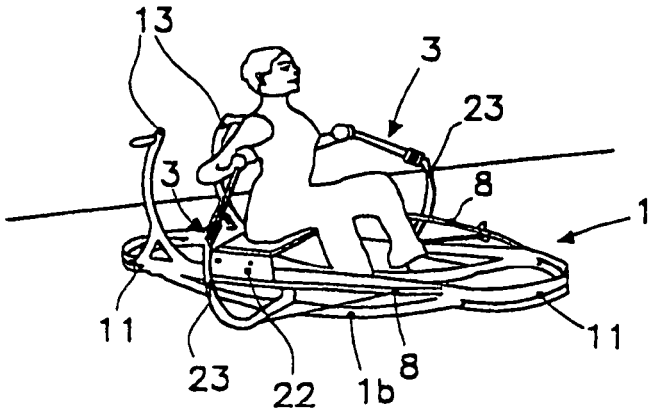
Figure 4F:
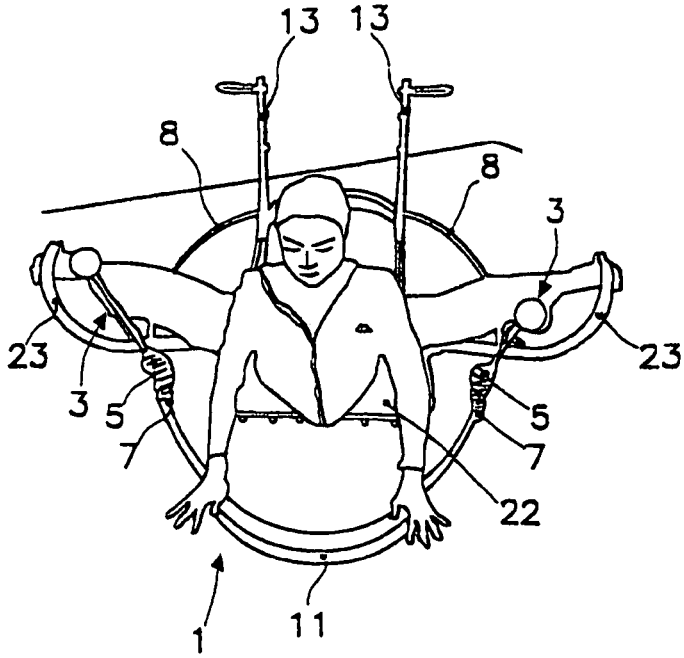

Turning now to FIGS. 4*d*-4*f*, seat 2 is replaced by slidable platform 22, supported by longitudinal sliding guides formed in frame 1*a* and made available upon removal of the seat. Movement of the user's upper limbs may then be coordinated with exercises that require flexion of the user's trunk and/or lower limbs, similar to those which may be conducted in a rowing simulation apparatus. Also, the rowing action can be personalized by suitably adjusting the height of handle members 3 or even, as shown in FIG. 4*e*, by detaching the same members from pedestal 1, and screwing them back onto supplementary or movable lateral supports 23, projecting sideways from the pedestal in a pivotable and elastically hindered manner. As best seen in FIG. 4*f*, the movable lateral supports may be used not only for the rowing movement, but also for exercises involving the lower limbs.

Further auxiliary devices/supports—such as conventional arrangements or, in any case, those having a known configuration—can be mounted to the base structure of the present invention, namely, oscillating pedestal 1, in order to make its versatility even greater. For example, a weight-lifting tower with pulleys and elastic cable systems may be provided, having, in addition, pedals and/or support boards, intended for use by the lower limbs, with exercises that can be carried out by the user positioned suitably over an appropriate seat.

Overall, a multipurpose exercise apparatus or equipment, according to the present invention, is particularly beneficial for its versatility, dynamism and adaptability to the user as compared to traditional exercise systems. The freedom of movement afforded by ball joints, advantageously displaceable over the pedestal, allows the user to drive the handle members in virtually any direction and inclination, without being restrained by predetermined trajectories. In this manner, the user's movements are not constrained, because his/her articulations are not compelled to follow a specific, predefined trajectory, unlike conventional apparatus in which the trajectory can not be changed during the same movement. This versatility of movement is also a result of the different positions that the user may assume (standing, sitting, kneeling, lying on his/her back, etc.), the user always being able to find an advantageous position for interaction with the handle members, and for utilizing the rocking support of the pedestal so as to not only combine training of the limbs with work on balance and on the proprioceptive sensibility, but also associating the equipment with a variety of auxiliary implements.

An exercise apparatus or equipment, according to the present invention, is particularly suitable for prevention and reeducation exercises of the whole body. In fact, if in case of a healthy articulation (with particular reference to the arm and shoulder), the handle members are driven using a relatively wide range of movements, an articulation that has suffered an injury will adapt to such movement naturally to the extent possible. The movement/exercises that can be accomplished using this apparatus, in addition to traditional physiotherapy, relate to and provide an introduction to those in disciplines such as dancing, yoga, tai chi chuan and the like.

Various modifications and alterations to the present invention may be appreciated based on a review of this disclosure. These changes and additions are intended to be within the scope and spirit of the invention as defined by the following claims.

The invention claimed is:

1. Exercise equipment comprising a pedestal, a seat supported by the pedestal, and handle members mounted to opposing sides of the pedestal, to be gripped generally at their top end by a user oriented relative to the seat, the pedestal having a curved base for permitting rocking movement of the pedestal about a substantially intermediate axis, generally orthogonal to opposing sides on which the handle members are placed, and the handle members comprising respective bar-shaped structures hinged to the pedestal via respective ball joints, the pedestal defining a top plane on which the seat is slidably mounted, whereby the user assists in the manual driving of the handle members using a flexion movement of his or her spine, the pedestal including a frame defining the plane, and a plurality of base arc-shaped beams projecting along respective longer sides of the frame, the longer sides being those along which the handle members are placed, the handle members being mounted on respective support brackets slidable over the pedestal, and a lock being provided for securing the handle members in a desired position and the pedestal having an arc-shaped structure projecting outwardly, and coplanarly relative to the top plane, for supporting the sliding of the brackets of the handle members.

2. The equipment set forth in claim 1, wherein the pedestal defines a top plane on which the seat is slidably mounted, whereby the user assists in manually driving the handle members using a flexion movement of his or her spine.

3. The equipment set forth in claim 1, wherein the pedestal comprises a member for stably supporting an inflatable sphere defining the seat.

4. The equipment set forth in claim 1, wherein the handle members are telescopically extendable for adjusting the height of the grip.

5. The equipment set forth in claim 1, wherein the arc-shaped structure comprises a plurality of arc-shaped rods, projecting outwardly from the longer sides of the frame.

6. The equipment set forth in claim 1, wherein the handle members are provided with further, respective ball joints in proximity to the top ends, so as to permit further articulation of the grip relative to the body of the handle member.

7. Exercise equipment comprising a pedestal, a seat supported by the pedestal, and handle members mounted to opposing sides of the pedestal, to be gripped generally at their top end by a user oriented relative to the seat, the pedestal having a curved base for permitting rocking movement of the pedestal about a substantially intermediate axis, generally orthogonal to opposing sides on which the handle members are placed, and the handle members comprising respective bar-shaped structures hinged to the pedestal via respective ball joints, the equipment further including fixed uprights on the pedestal, to be gripped at the top ends for use as an auxiliary support, brace or abutment, the handle members being reversibly connected to the pedestal.

8. The equipment set forth in claim 1, wherein longitudinal ends of the pedestal include respective hinged structures, pivotable downwardly in an adjustable manner, so as to abut a plane of the ground and, thereby, either limit the extent of rocking of the pedestal, or prevent such rocking.

9. Exercise equipment comprising a pedestal, a seat supported by the pedestal, and handle members mounted to opposing sides of the pedestal, to be gripped generally at their top end by a user oriented relative to the seat, the pedestal having a curved base for permitting rocking movement of the pedestal about a substantially intermediate axis, generally orthogonal to opposing sides on which the handle members are placed, the handle members comprising respective bar-shaped structures hinged to the pedestal via respective ball joints, and the handle members being reversibly connected to the pedestal.

10. The equipment set forth in claim 9, comprising a plurality of supplementary supports, projecting generally laterally from the pedestal in a pivotable and elastically hindered manner, and fit for connection with the handle members.

11. The equipment set forth in claim 1, wherein the pedestal supports a tower with a weight-lifting system for workout of the user's lower limbs.

12. The equipment set forth in claim 9, wherein the handle members are threadably engaged with the pedestal.

13. The equipment set forth in claim 9, adapted for the mounting of a plurality of supplementary supports, projecting generally laterally from the pedestal in a pivotable and elastically hindered manner, and fit for connection with the handle members.

* * * * *